United States Patent [19]

Hardie

[11] 4,387,379

[45] Jun. 7, 1983

[54] RADIO FREQUENCY ANTENNA

[75] Inventor: George S. Hardie, Santa Barbara, Calif.

[73] Assignee: Raytheon Company, Lexington, Mass.

[21] Appl. No.: 196,800

[22] Filed: Oct. 14, 1980

[51] Int. Cl.[3] ..... H01Q 1/36

[52] U.S. Cl. ..... 343/895

[58] Field of Search ..... 343/701, 703, 895

[56] References Cited

U.S. PATENT DOCUMENTS

| | | | |
|---|---|---|---|
| 3,555,554 | 1/1971 | Kuo | 343/895 |
| 3,789,299 | 1/1974 | Aslan | 343/703 |
| 3,828,251 | 8/1974 | Webb | 343/703 |
| 4,291,312 | 9/1981 | Kaloi | 343/700 MS |
| 4,319,248 | 3/1982 | Flam . | |

*Primary Examiner*—Eli Lieberman

*Attorney, Agent, or Firm*—Richard M. Sharkansky; Joseph D. Pannone

[57] ABSTRACT

A radio frequency antenna having a pair of conductors disposed over a ground plane conductor. First ends of the pair of electrical conductors are coupled to a detector means, a second end of one of the pair of conductors is electrically connected to the ground plane conductor and a second end of the other one of the pair of conductors is adapted to carry video frequency signals. In a preferred embodiment of the invention the pair of conductors is configured to spiral inwardly from an outer region of the antenna to an inner region of the antenna. The ends of the conductors disposed proximate the inner region of the antenna are coupled to a detector means. The ground plane conductor has a cavity disposed beneath the inner region of the antenna. The cavity is conically shaped and the detector means is directly bonded to the ends of the pair of conductors disposed proximate the inner region of the antenna. With such arrangement an inward traveling electromagnetic wave received by the spiral antenna is detected by the diode means and converted into a video frequency signal without the requirement of a balun. The detected video signal is coupled from the antenna at the outer end of the nongrounded one of the spiral conductors to a video amplifier. The outer end of the other one of the spiral windings is grounded to the ground plane conductor to provide a D.C. return for the video signal.

3 Claims, 6 Drawing Figures

FIG. 2
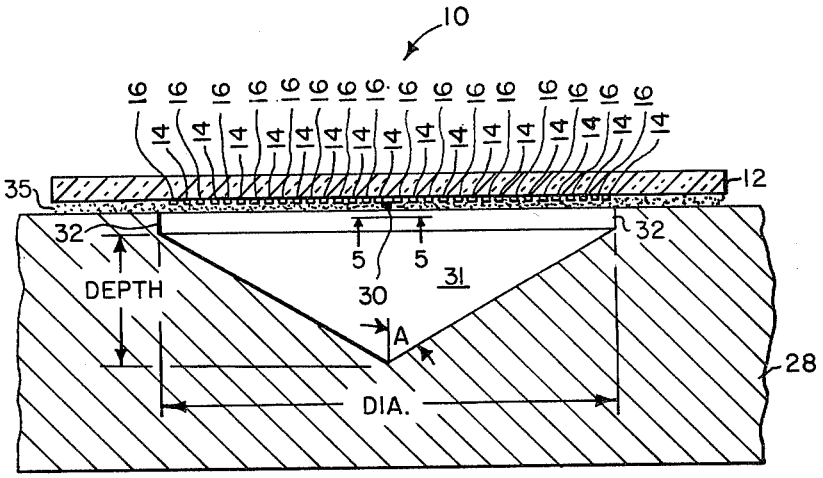
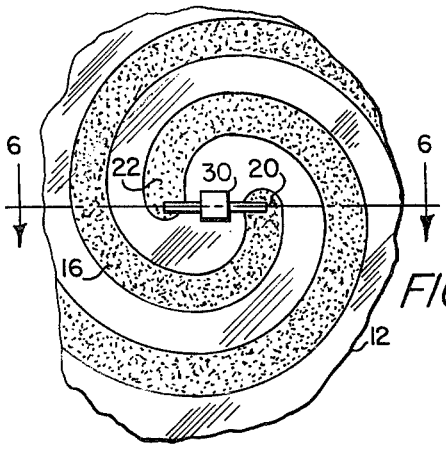
FIG. 5
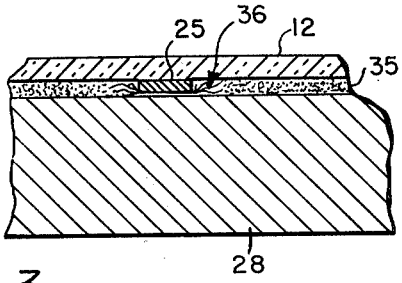
FIG. 3
FIG. 6
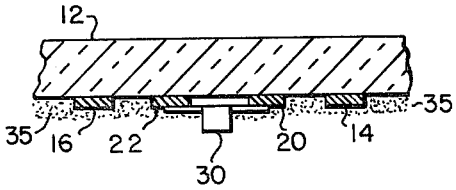
FIG. 4
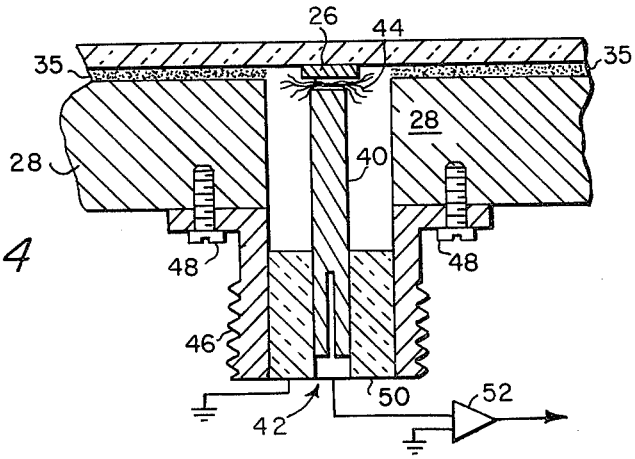

RADIO FREQUENCY ANTENNA

BACKGROUND OF THE INVENTION

This invention relates generally to radio frequency antennas and more particularly to small, compact, radio frequency antennas.

As is known in the art, one type of radio frequency antenna is a so-called "spiral antenna". Such antenna is generally characterized by a pair of dipole conductors which spiral inwardly from an outer portion of the antenna to an inner portion of the antenna. The inner ends of each of the conductors are disposed adjacent one another and are generally connected to a radio frequency coaxial connector through a balun. The pair of spiral conductors is disposed in a plane and the balun is usually contained in a cavity which backs the pair of spiral conductors. An incident electromagnetic wave excites currents in the spiral-shaped conductors. Some of the currents contribute to an inward spiraling electromagnetic wave similar in configuration to the type of wave found on a balanced two-wire transmission line. The balun which is attached to two adjacent inner ends of the spiral conductors converts the balanced wave on the spiral conductors to an unbalanced coaxial TEM wave and transforms the impedance of the spiral conductors to match the characteristic impedance of the coaxial connector and its attached coaxial transmission line. If the radio frequency signal received by the antenna is to be converted to a video signal a detector is employed and is generally attached to the coaxial connector as a separate component.

While the spiral antenna described above is useful in many applications, such structure is difficult to fabricate when operating in a frequency range of between 10 to 100 GHz. More particularly, when such antenna is to operate with millimeter wavelength signals the size of the required balun would be extremely small and difficult to fabricate and the lengths of the transmission line required would be excessively lossy.

SUMMARY OF THE INVENTION

In accordance with the present invention a radio frequency antenna is provided having a pair of electrical conductors disposed over a ground plane conductor. First ends of the pair of electrical conductors are coupled to a detector means, a second end of one of the pair of conductors is electrically connected to the ground plane conductor and a second end of the other one of the pair of conductors is adapted to carry video frequency signals. In a preferred embodiment of the invention the pair of conductors is configured to spiral inwardly from an outer region of the antenna to an inner region of the antenna. The ends of the conductors disposed proximate the inner region of the antenna are coupled to a detector means. The ground plane conductor has a cavity disposed beneath the inner region of the antenna. The cavity is conically shaped and the detector means is directly bonded to the ends of the pair of conductors disposed proximate the inner region of the antenna. With such arrangement an inward traveling electromagnetic wave received by the spiral antenna is detected by the diode means and converted into a video frequency signal without the requirement of a balun. The detected video signal is coupled from the antenna at the outer end of the nongrounded one of the spiral conductors to a video amplifier. The outer end of the other one of the spiral windings is grounded to the ground plane conductor to provide a D.C. return for the video signal.

BRIEF DESCRIPTION OF THE DRAWINGS

The foregoing features of the invention as well as the invention itself may be fully understood from the following detailed description read together with the accompanying drawings in which

FIG. 2 is a cross-sectional view of a portion of the radio frequency antenna of FIG. 1, such cross-section being taken along line 2—2 of FIG. 1;

FIG. 3 is a cross-sectional view of a portion of the radio frequency antenna of FIG. 1, such cross-section being taken along line 3—3 of FIG. 1;

FIG. 4 is a cross-sectional view of a portion of the radio frequency antenna of FIG. 1, such cross-section being taken along line 4—4 of FIG. 1;

FIG. 5 is a plan view of the central portion of the antenna shown in FIG. 1 looking in the direction of arrows 5—5 in FIG. 2; and FIG. 6 is a cross-sectional view of the central portion of the antenna, such cross-sectional view being taken along line 6—6 in FIG. 5.

DESCRIPTION OF THE PREFERRED EMBODIMENT

Figure 1:
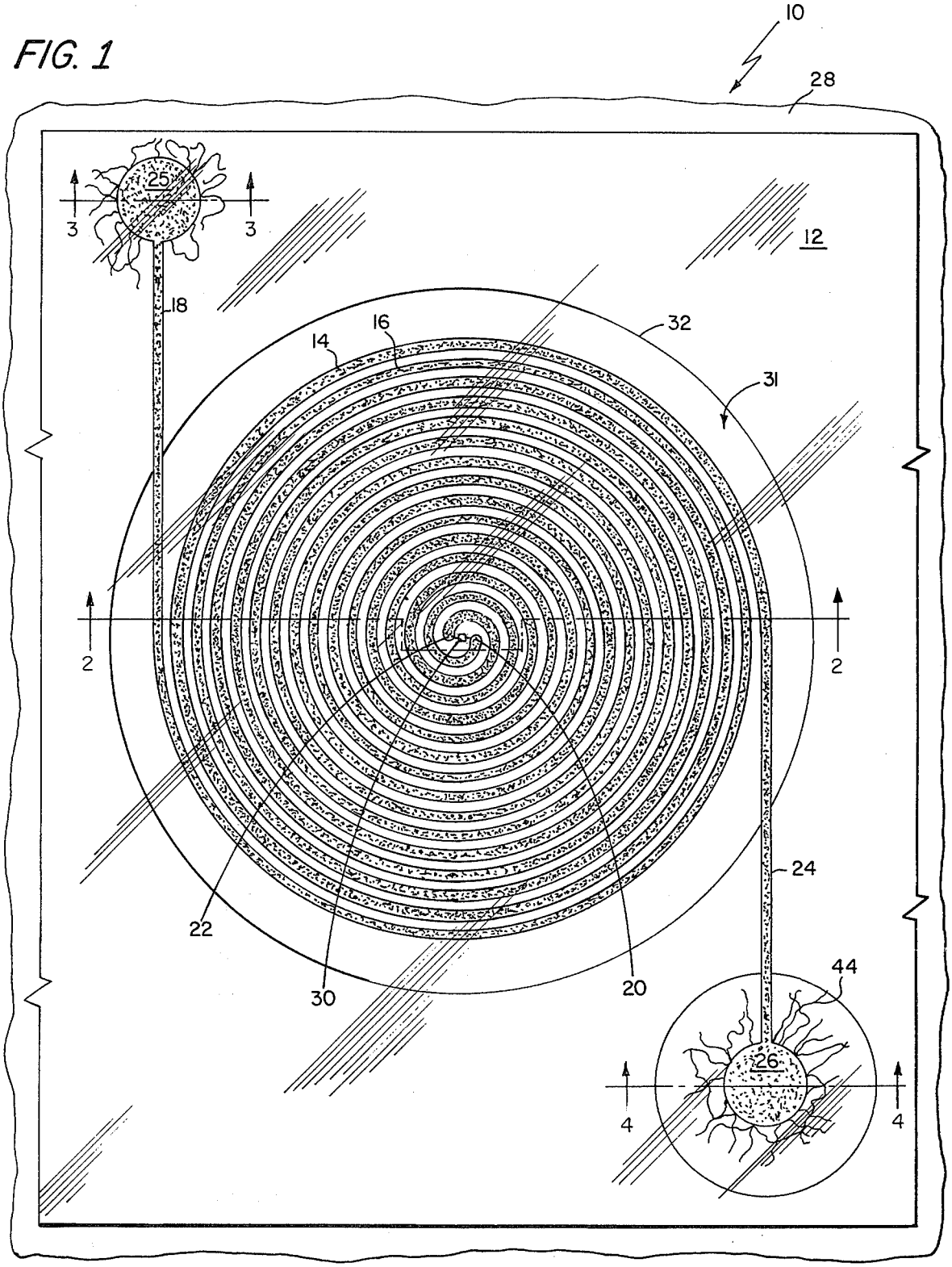
FIG. 1 is a plan view of a radio frequency antenna according to the invention.

Referring now to FIGS. 1–6, a radio frequency antenna 10 is shown to include a dielectric substrate 12, here quartz, having a thickness of 0.009 inches. Here the quartz substrate 12 is square, having length and width dimensions of 0.50 inches. A pair of spiral conductors 14, 16 is formed on the lower surface of the quartz substrate 12 using conventional photolithographic chemical etching techniques. More particularly, a layer of a suitable conductor such as gold is formed on such lower surface of the quartz substrate 12 and a bifilar Archemedian spiral pattern is etched using conventional photolithographic techniques. Here the Archemedian spiral pattern is complementary, having a line width of 0.005 inches. The spiral conductor 16 has an end portion 18 disposed proximate an outer region of the antenna 10 and has a second inner end 20 disposed proximate a central or inner region of the antenna 10. The outer end portion 18 terminates in a contact tab 25, as shown. The spiral conductor 14 has an end portion 24 disposed proximate another outer region of the antenna 10 and has a second, inner end 22 disposed proximate the central or inner region of the antenna 10. The outer end portion 24 of conductor 14 terminates in a contact tab 26, as shown.

As shown in FIG. 2, the quartz substrate 12 is disposed over a ground plane conductor 28, here aluminum, having a conically shaped cavity 31 disposed beneath the major portion of the spiral conductors 14, 16. A diode detector 30 has anode and cathode terminals directly connected, here gap welded, between inner ends 20 and 22 of conductors 16, 14 as shown more clearly in FIGS. 5 and 6. Here diode detector 30 is a beam lead device, here Model #HP5082-2767 manufactured by Hewlett Packard of Palo Alto, Calif. The cavity 31 is formed with a half-cone angle A of 60°, the outer perimeter of the cone-shaped cavity 31 being indicated by numeral 32 in FIGS. 1 and 2. The antenna 10 here is adapted to operate over a band of frequencies 18 to 100 GHz. The outer diameter of the spiral conductors 14, 16 should exceed $(1.2/\pi)\times$(velocity of light/$18\times10^9$ Hz)=0.250 inches, where $18\times10^9$ HZ is the lowest operating frequency of the antenna 10. The ends 20, 22 of conductors 14, 16 should be as near the center region of the spiral antenna 10 as practical but must be within the active region at the upper operating frequency of the antenna. For an axial mode spiral antenna the active region lies between circumferences of 0.8 and 1.2 wavelengths. This means that the ends 20, 22 must lie within a circle having a diameter of ($0.8/\pi\times$(velocity of light/$100\times10^9$ Hz)=0.030 inches), where $100\times10^9$ HZ is the highest operating wavelength of the antenna 10 and preferably should be as small as possible. For the smoothest antenna patterns and for the greatest bandwidth the number of windings of the conductors 14, 16 in the active region should be large; however, for the lowest power dissipation loss in the conductors the number of windings should be small. The usual compromise made should be that two to four windings of the conductors 14, 16 should be disposed in the active region. For a constant conductor width, that is for an Archemedian spiral, and a complementary structure, this criteria, applied at 100 GHz, results in a conductor width of between 1.1 and 2.5 thousandths of an inch.

Contact tab 25 of conductor 16 is grounded to the ground plane conductor 28, here through a mesh of conductive material 36, here 0.001 inch diameter gold wire. It is noted that a coating of a layer 35 of varnish or other suitable dielectric is applied over the ground plane conductor 28 to insulate the conductors 14, 16 from the conductive ground plane except for the region where contact tab 25 becomes electrically connected to the ground plane conductor 28 as shown in FIG. 3. As shown in FIG. 4, contact tab 26 is electrically connected to the center conductor 40 of a coaxial connector 42 through a mesh of gold wire 44 (similar to material 36). The outer conductor 46 of the coaxial connector 42 is electrically connected to the ground plane conductor 28, here by mounting screws 48 as shown in FIG. 4. The center conductor 40 of coaxial connector 42 is separated from the outer conductor 46 by a suitable dielectric 50 (here Teflon material), as shown. With this arrangement a received electromagnetic wave travels inwardly toward the central or inner region of the antenna 10 and is detected by the diode detector 30, producing a video frequency signal on contact tab 26 which is extracted from the antenna 10 via the coaxial connector 42, the ground plane providing a D.C. return for the video frequency signal, such video signal being fed directly to a video amplifier 52, as shown in FIG. 4.

Having described a preferred embodiment of this invention, it is now evident that other embodiments incorporating its concepts may be used. It is felt, therefore, that this invention should not be restricted to such preferred embodiment, but rather should be limited only by the spirit and scope of the appended claims.

What is claimed is:

1. A radio frequency antenna comprising:

(a) a dielectric substrate;

(b) a pair of spiral configured conductors disposed on the substrate, such pair of conductors spiraling inwardly from an outer region of the antenna to an inner region of the antenna, a first one of such conductors having a contact region at an end thereof and disposed on the dielectric substrate at the outer region of the antenna;

(c) a diode detector connected directly between ends of the pair of conductors disposed at the inner region of the antenna;

(d) a ground plane conductor having a cavity formed therein, such cavity being disposed under the inner region of the antenna, such ground plane conductor being electrically connected to an end of a second one of the pair of conductors, such end being disposed at the outer region of the antenna; and (e) a coaxial transmission line having an outer conductor mounted to the ground plane conductor and an inner conductor electrically connected to the contact region, and wherein the inner conductor and the contact region are aligned one under the other, and wherein the inner conductor and the contact region are spaced from the cavity.

2. The antenna recited in claim 1 wherein the cavity is conically-shaped, with the base thereof proximate the substrate.

3. The antenna recited in claim 1 wherein the second one of the spiral configured conductors has a conductive tab formed at an end thereof disposed at the outer region of the antenna and wherein such conductive tab of such second one of the spiral configured conductors is disposed over, and electrically connected to, the ground plane conductor.

* * * * *